US005480325A

United States Patent [19]

Tran et al.

[11] Patent Number: 5,480,325

[45] Date of Patent: Jan. 2, 1996

[54] COAXIAL CONNECTOR PLUG AND METHOD FOR ASSEMBLY

[75] Inventors: Nam D. Tran; Peter D. Nguyen; Richard J. MacConnell, all of Fort Worth, Tex.

[73] Assignee: Tandy Corporation, Fort Worth, Tex.

[21] Appl. No.: 250,581

[22] Filed: May 27, 1994

[51] Int. Cl.[6] ..... H01R 9/07

[52] U.S. Cl. ..... 439/578; 439/874; 29/860

[58] Field of Search ..... 439/874, 875, 439/80, 578–585, 932, 936, 675, 276

[56] References Cited

U.S. PATENT DOCUMENTS

| | | | |
|---|---|---|---|
| 764,654 | 12/1856 | Antiference . | |
| 1,706,005 | 3/1929 | Thompson . | |
| 2,501,870 | 3/1950 | Malhiot . | |
| 3,103,548 | 9/1963 | Concelman . | |
| 3,221,290 | 11/1965 | Stark et al. . | |
| 3,295,094 | 12/1966 | Lyon et al. . | |
| 3,297,979 | 1/1967 | O'Keefe et al. . | |
| 3,728,787 | 4/1973 | McDonough . | |
| 4,135,776 | 1/1979 | Ailawadhi et al. . | |
| 4,269,469 | 5/1981 | Audic . | |
| 4,600,263 | 7/1986 | De Champ et al. | 439/932 |
| 4,690,481 | 9/1987 | Randolph . | |
| 4,781,602 | 11/1988 | Cobaugh | 439/936 |
| 4,966,560 | 10/1990 | Marzouk . | |
| 5,118,313 | 6/1992 | Delalle | 439/936 |
| 5,147,221 | 9/1992 | Cull et al. | 439/585 |
| 5,207,596 | 5/1993 | Tran . | |

FOREIGN PATENT DOCUMENTS

| | | |
|---|---|---|
| 1124349 | 5/1982 | Canada . |
| 2382112 | 10/1978 | France . |
| 2601196 | 1/1988 | France . |
| 1109914 | 4/1968 | United Kingdom . |

*Primary Examiner*—David L. Pirlot
*Attorney, Agent, or Firm*—Haynes and Boone

[57] ABSTRACT

A coaxial connector plug and method for securing a coaxial cable in the plug without the need for crimping, trimming, or soldering the tip of the plug. A preformed solder, solder paste, or any type of conductive adhesive is deposited in the closed tip of a coaxial connector plug. The center conductive cable is then inserted into the adhesive material of the closed tip and heated to melt or cure the adhesive material, thereby establishing an electrical connection.

19 Claims, 2 Drawing Sheets

COAXIAL CONNECTOR PLUG AND METHOD FOR ASSEMBLY

TECHNICAL FIELD

This invention relates generally to coaxial connector plugs and, more particularly, to a closed-tip coaxial connector plug and an automated method of securing a coaxial cable thereto.

BACKGROUND OF THE INVENTION

Currently, coaxial cables that are electrically and mechanically connected to coaxial connector plugs with solder require a labor intensive method of assembly that has many limitations. One such limitation is that many of the steps must be performed by hand. Hand assembly increases the cost of manufacture and poses risk of injury to the laborer occasioned by the use of sharp cutting blades and hot soldering irons. Moreover, handling of the cable during the assembly process results in additional injuries as the cable filaments tend to prick the fingers and hands of the laborer.

In the hand assembly of soldered coaxial connector plugs, the cable is first cut a predetermined length. Next, a portion of the cable's outer jacket is stripped from each end to expose the braided inner cable underneath. The braided inner cable is then debraided by machine and twisted. A portion of the insulation surrounding the inner cable is then stripped to expose the inner cable for electrical connection. The stripped inner cable is twisted and inserted through an opening at the tip of the center conductor, or pin, of the coaxial connector plug. A conductor is placed on the portion of the cable extending out of the connector plug opening, which opening is then dipped into solder, cleaned, and filed. Next, the twisted portion of the cable extending through the opening is soldered to the shell with a soldering iron and trimmed with a cable cutter. Finally, the assembled connector plug is ready for a plug molding to cover the outer shell of the connector.

A solution to the problems of manual soldering of coaxial connector plugs to a coaxial cable has been to crimp the connector to the cable. Most forms of crimping use a process of crimping the very tip of the center conductor pin. For some methods this may be the only crimp that is performed. A prong embedded through the outer insulative jacket to the outer braid conductor provides mechanical and electrical contact to the outer braid conductor. Problems associated with crimping the tip include that, upon insertion, the center cable can bend or be misguided so when the crimp occurs, no mechanical or electrical connection is achieved. Moreover, stray cables in a filament-type center conductor may fold back and cause electrical shorting if there is inadequate insulation between the outer and inner conductor shells of the connector plug. Finally, the crimp force of a single point crimp may deform the center conductor pin causing the center conductor pin to be mis-shapened so it cannot be properly inserted into the receptor portion of the coaxial connection assembly.

An improvement over the above-described methods is found in U.S. Pat. No. 5,207,596 which has been assigned to the assignee of the present invention. In that patent, a solderless coaxial cable connector and method for attachment is disclosed. The coaxial connector disclosed uses a closed-end coaxial plug whose electrical connection is made via double crimps made in at least three spaced apart positions about the circumference of the neck of the plug and the cable receptor portion. This connector poses problems, however, because the areas of double crimping are subject to failure due to fatigue. In addition, extra insulation is required between the outer surface of the plug and the coaxial cable to prevent shorting of the electrical connection between the cable and the connector housing, which extra insulation increases the overall cost of manufacturing the plug.

Accordingly, what is needed is an improved coaxial connector plug and method of assembly that avoids the above problems. In addition, the method should be automated to reduce the high cost of manual labor and to improve the yield rate of commercial product.

SUMMARY OF THE INVENTION

The foregoing problems are solved and a technical advance is achieved by a coaxial cable connector having a closed tip and method of assembly which may be easily automated. The coaxial connector plug of the present invention is comprised of a closed-tip center pin, a conductive housing and a conventional coaxial cable comprised of an outer insulative jacket, a braided conductive shield, an inner insulative sleeve, and a center conductive cable.

In a departure from the prior art, preformed solder, solder paste, or any type of conductive adhesive is deposited in the closed-tip center pin of a coaxial connector plug. After the conductive adhesive has been deposited in the closed-tip center pin, an exposed end of the center conductive cable of the coaxial cable is inserted into the adhesive material. Heat in the form of a conventional flame, hot air, focused light, inductive coils, or electrical resistance is then applied to the outside of the closed-tip center pin to melt or cure the adhesive material, thereby forming an electrical connection between the center conductive cable of the coaxial cable and the center pin.

Next, the braided conductive shield is mechanically and electrically connected to the conductive housing by crimping a flanged portion of the housing on the braided conductive shield.

A technical advantage is achieved by connecting a coaxial cable to a coaxial connector plug having a closed-tip center pin. Specifically, using a closed-tip center pin eliminates exposed cables that would otherwise have to be manually trimmed, dipped into solder, cleaned, and filed. Nor does the twisted braid portion, which would typically extend past the outer shell of the coaxial connector plug, have to be soldered to the outer shell with a soldering iron, thereby eliminating the steps of manually trimming any material extending past the outer shell of the plug.

An additional technical advantage achieved with the invention is an improved electrical connection between the center conductive cable and the coaxial plug. In the present invention, this connection is located in the center pin of the connector plug, not in the neck portion where the connection would be subject to interruption because of fatigue failure in the crimp.

An additional technical advantage is achieved by reducing the amount of required crimping, thus, eliminating the problems associated with crimping, namely, fatigue in the connector housing, misguided cables interfering with the mechanical or electrical connection, stray cables folding back causing electrical shorting, and deformation of the center conductor pin causing insertion problems with the receptor portion of the coaxial connection assembly.

DESCRIPTION OF THE PREFERRED EMBODIMENT

Figure 1:
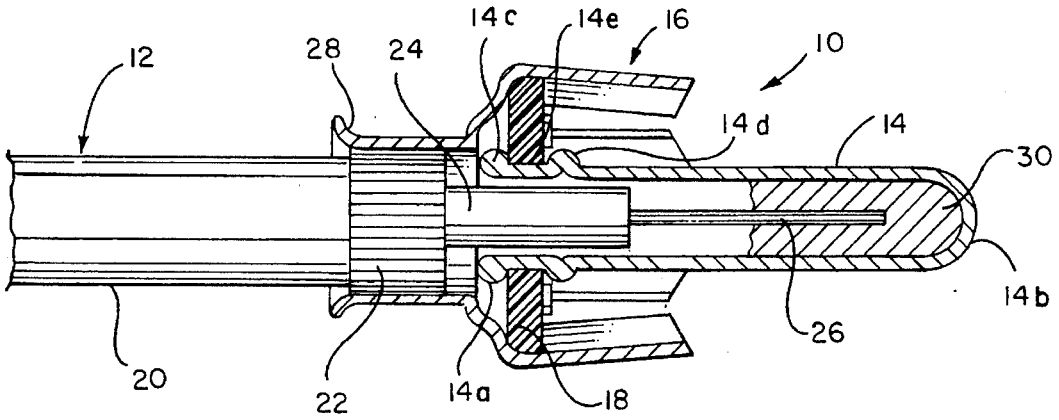
FIG. 1 is a cross-sectional view of a coaxial cable attached to a coaxial connector plug according to the present invention.

Referring to FIG. 1 of the drawings, the reference numeral 10 refers to a coaxial connector plug embodying principles of the present invention. The plug 10 is comprised of a coaxial cable 12, a cylindrical center pin 14, and a conductive housing 16. The housing 16 is separated from the pin 14 by a dialectic insulative washer 18 that secures the pin 14 inside the housing 16 and prevents electrical shorting therebetween. The pin 14 has an open end 14*a* for receiving a portion of the coaxial cable 12 and a closed tip 14*b*. The end 14*a* is defined by a first lip 14*c* and spaced therefrom is a second lip 14*d*, which together define an insulator washer seat 14*e* for retaining the washer 18.

Figure 2:
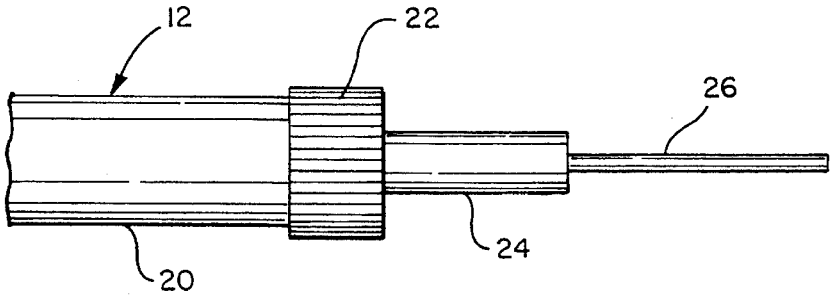
FIG. 2 is partially broken away, side view of the coaxial cable of FIG. 1.

Referring also to FIG. 2, the coaxial cable 12 includes an outer insulative jacket 20, a braided conductive shield 22, an inner insulative sleeve 24, and a center conductive cable 26, it being understood that the conductive shield 22 need not be braided but can be formed of other conventional conductors. The housing 16 includes a flared bottom cable reception portion 28 for receiving the coaxial cable 12. The diameter of the reception portion 28 is slightly larger than the diameter of the braided conductive shield 22 once pulled back against the outer insulative jacket 20 as described below for providing a snug fit therebetween.

Disposed within the closed tip 14*b* of the pin 14 is a joining material 30. The joining material 30 may be preformed solder, solder paste, or any type of conductive adhesive material that will facilitate an electrical connection between the pin 14 and the center conductive cable 26.

Figure 3:
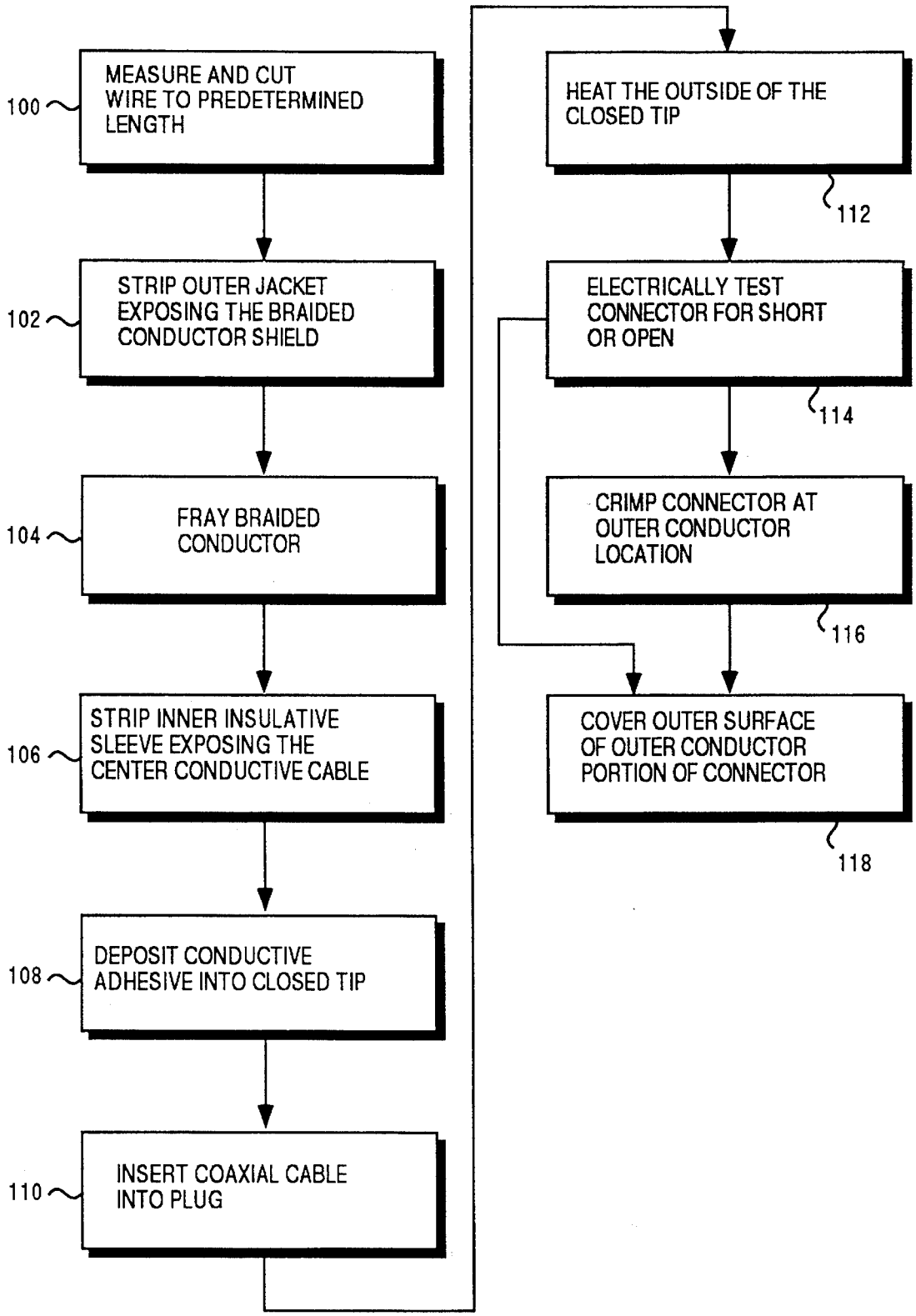
FIG. 3 is a flow chart describing the steps used in the manufacture of the coaxial connector plug according to the present invention.

The steps used in the manufacture of the plug 10 according to the present invention are shown in FIG. 3. In step 100, the coaxial cable 12 is measured and cut to a predetermined length. In step 102, the outer insulative jacket 20 is stripped away exposing the braided conductive shield 22. In step 104, the braided conductive shield 22 is de-braided or frayed and pulled back against the outer insulative jacket 20 to expose the inner insulative sleeve 24. In step 106, an end portion of the inner insulative sleeve 24 is stripped to expose the center conductive cable 26. The coaxial cable 12 is now ready for insertion into the pin 14.

In step 108, a predetermined amount of the joining material 30 is deposited in the closed tip 14*b* of the pin 14. In step 110, the coaxial cable 12 is then inserted into the pin 14, via the end 14*a*, as cross-sectionally shown in FIG. 1. The flared end of the reception portion 28 allows the center conductor cable 26 to be inserted without the bending or fraying of the center conductor cable 26. The depth of insertion is calculated so that the center conductive cable 26 is sufficiently emersed into the joining material 30 to maintain an electrical contact after heating of the joining material 30 as described below. Further, the center conductor cable 26 along with the inner insulative sleeve 24 extends into the pin 14 beyond the insulative washer 18. The sleeve 24 supports the interior diameter of the pin 14 when the reception portion 28 is crimped, as discussed below.

Figure 4:
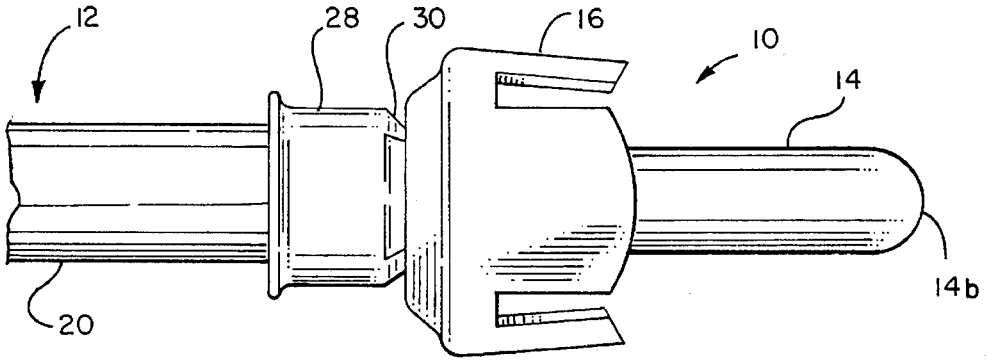
FIG. 4 is a side view of the coaxial connector plug of FIG. 1 depicting a crimped reception portion.

Once the coaxial cable 12 is inserted into the housing 16, the center conductor cable 26 is electrically connected to the pin 14 by heating the outside of the tip 14*b* of the pin 14 to cure or melt the joining material 30 (step 112). The heat source may be any type of conventional source including flame, hot air, focused light, an inductive coil, or an electrical resistance device. After heating, the plug 10 is tested for conductivity by applying a voltage on one end of the center conductor cable 26 and measuring the voltage on the other end through the pin 14 (step 114). If the center conductor cable 26 passes testing in step 114, the reception portion 28 is crimped about the braided conductive shield 22 (step 116), as shown in FIG. 4 by reference numeral 32. The crimp 32 adds mechanical connectivity to the plug 10 and ensures electrical connection between the housing 16 and the braided conductive shield 22. After crimping, an electrical test may be conducted to verify that electrical integrity has been achieved between the housing 16 and the braided conductive shield and maintained between the pin 14 and the center conductor cable 26.

Preferably, the crimping is achieved by providing at least three crimp dice (not shown) about the circumference of the reception portion 28. The dice are equally spaced apart so that the crimp pressure does not unduly deform the plug 10. In step 118, the plug 10 is provided with an insulative outer coating (not shown) on the outer surface of the housing 16 and on a portion of the coaxial cable 12.

As can be appreciated, the coaxial connector plug 10 and method of assembly according to the present invention provides a significant improvement over the present art, including, eliminating the steps of manually trimming the material that typically extends past the outer shell of the plug. Also, the electrical connection is improved because it is located in the center pin of the connector plug, not in the neck portion where the connection may be interrupted because of fatigue in the area of the crimp. Additionally, by not having to crimp the end of the coaxial connector plug nor the neck portion of the connector housing, the problems associated with double or single crimping, namely, fatigue in the connector housing, misguided cables interfering with the mechanical or electrical connection, stray cables folding back causing electrical shorting, and deformation of the center conductor pin are eliminated. Therefore, the present invention provides a simple and inexpensive coaxial connector that can be automated and used in a manner that provides a quick and complete electrical connection of the components while reducing the probability of malfunctions that normally occur during the crimping or soldering process of typical assembly methods.

Although an illustrative embodiment of the invention have been shown and described, a latitude of modification, change, and substitution is intended in the foregoing disclosure and in some instances some features of the invention will be employed without a corresponding use of other features. For example, the step 112 of heating the outside of the tip 14*b* of the pin 14 to melt or cure the joining material 30 and the step 116 of crimping the reception portion 28 about the braided conductive shield 22 can be reversed in time such that step 116 precedes step 112. Accordingly, it is appropriate that the appended claims be construed broadly and in a manner consistent with the scope of the invention.

What is claimed is:

1. A coaxial connector plug comprising:

a conductive housing;

a hollow cylindrical center pin extending from said housing, said center pin having an open end for receiving a center conductor of a coaxial cable and an entirely closed tip;

means for electrically insulating said housing from said center pin; and means disposed in said entirely closed tip of said center pin for establishing a permanent connection between said center pin and said center conductor disposed in said center pin.

2. The coaxial connector plug of claim 1 wherein said insulating means comprises a dielectric washer disposed within said insulator seat and extending outwardly to said housing.

3. The coaxial connector plug of claim 1 wherein an inner insulative jacket of said coaxial cable extends into said center pin.

4. The coaxial connector plug of claim 1 wherein said center conductor extends into said establishing means.

5. The coaxial connector plug of claim 1 wherein said establishing means is preformed solder.

6. The coaxial connector plug of claim 1 wherein said establishing means is cold solder.

7. The coaxial connector plug of claim 1 wherein said housing comprises a reduced diameter portion for forming an electrical and mechanical connection with a conductive shield of said coaxial cable.

8. The coaxial connector plug of claim 7 wherein said mechanical connection is formed by crimping said reduced diameter portion.

9. A method for attaching a coaxial connector plug having a conductive housing to a coaxial cable having an outer insulative jacket, a conductive shield, an inner insulator, and a center conductive cable, said coaxial connecter plug further comprising a hollow cylindrical center pin having an entirely closed tip, said housing being separated from said center pin by a dielectric washer and having a cable reception portion, said cable reception portion having an end whose diameter is slightly larger than the diameter of said coaxial cable, the method comprising the steps of:

cutting said coaxial cable to a given length;

exposing said shield at one end of said coaxial cable;

overlaying said exposed portion of said shield over a portion of said outer insulative jacket;

removing a portion of said inner insulator, thereby exposing said center conductive cable;

disposing a conductive adhesive in said entirely closed tip of said center pin;

loading said coaxial cable into said conductive housing using said cable reception portion to guide said center conductive cable into said housing with said exposed center conductive cable coming to rest in the entirely closed tip of said center pin and said overlaid portion of said shield coming to rest in said reception portion of said second portion of said housing; and heating said entirely closed tip of said center pin, thereby providing electrical connectivity between said center pin and said center conductive cable.

10. The method according to claim 9 further comprising the step of electrically testing said electrical connectivity after said heating.

11. The method according to claim 9 further comprising the step of molding a protective layer to the outer surfaces of said cable reception portion and a portion of said housing.

12. The method according to claim 9 further comprising the step of crimping said cable reception portion, thereby providing mechanical and electrical connectivity between said shield and said housing.

13. The method according to claim 12 further comprising the step of electrically testing said electrical connectivity between said shield and said housing.

14. A method of attaching the first and second electrical leads of a coaxial cable to a coaxial connector plug having a housing and a hollow entirely closed tip center pin extending therefrom, the method comprising the steps of:

exposing end portions of said first and second leads such that said first lead extends past said second lead;

disposing a conductive adhesive in said center pin;

inserting said cable into said plug such that said first lead extends within said center pin; and heating said adhesive to establish a permanent electrical connection between said first lead and said center pin.

15. The method of claim 14 wherein said coaxial cable further comprises an insulator disposed between said first and second leads, said method further comprising the step of inserting a portion of said coaxial cable insulator into said center pin.

16. The method of claim 14 further comprising the step of electrically connecting said second lead to said housing.

17. The method of claim 16 further comprising the step of mechanically connecting said second lead to said housing by crimping said housing.

18. The method of claim 14 further comprising the step of electrically insulating said center pin from said housing by a single insulator.

19. The method of claim 18 wherein said insulator is a circular washer extending between an end portion of said center pin and said housing.

* * * * *